United States Patent [19]

Tidalgo et al.

[11] Patent Number: 5,024,440

[45] Date of Patent: Jun. 18, 1991

[54] DICE A WORD

[76] Inventors: Max B. Tidalgo, 12003 Alondra Blvd., Norwalk, Calif. 90650; George Spector, 233 Broadway, New York, N.Y. 10007

[21] Appl. No.: 487,867

[22] Filed: Mar. 5, 1990

[51] Int. Cl.[5] ..... A63F 9/04

[52] U.S. Cl. ..... 273/145 A; 273/146

[58] Field of Search ..... 273/145 R, 145 A, 146, 273/272, 1 GE; 40/628

[56] References Cited

U.S. PATENT DOCUMENTS 3,707,300 12/1972 Tamburro et al. ..... 40/628 X 4,421,315 12/1983 Cutler ..... 273/272 X

OTHER PUBLICATIONS

Scrabble® Crossword Cubes, Selchow and Righter One Hundredth Anniversary Game Catalog, pp. 12, 13.

*Primary Examiner*—William H. Grieb

[57] ABSTRACT

A word building game is provided and consists of a plurality of playing cubes each having a letter with a score value on each side thereof. A two minute timer is for timing the play of the game after the cubes are cast upon a flat surface. A player can form at least one word from the letters on the top sides of the cubes and then add up the score values.

2 Claims, 1 Drawing Sheet

DICE A WORD

BACKGROUND OF THE INVENTION

The instant invention realtes generally to game and more specifically it relates to a word building game which provides a plurality of playing cubes having letter indicia thereon for forming words to play the game.

There are available various conventional games which do not provide the novel improvement of the invention herein disclosed.

SUMMARY OF THE INVENTION

A primary object of the present invention is to provide a word building game that will overcome the shortcomings of the prior art devices.

Another object is to provide a word building game utilizing a plurality of playing cubes having letter indicia thereon for forming words so as to promote the enrichment of a players vocabulary and encourage the player to be alert when playing the game.

An additional object is to provide a word building game that includes an hourglass timer combined with a scooper to hold the playing cubes so as to enhance the equipment used in playing the game.

A further object is to provide a word building game that is simple and easy to use.

A still further object is to provide a word building game that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
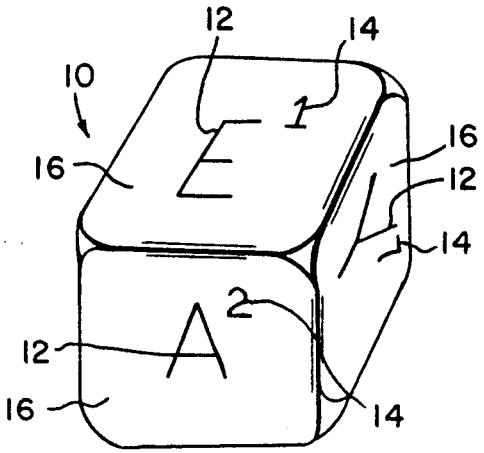
FIG. 1 is a perspective view of one of the playing cubes used in playing the game.
Figure 2:
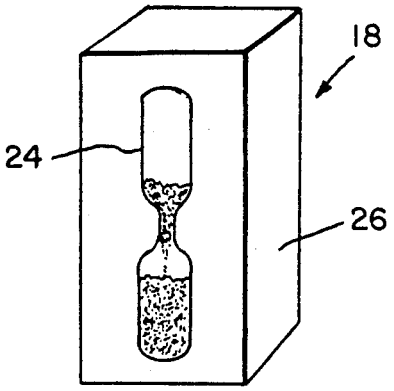
FIG. 2 is a perspective view of an hourglass timer used in the game.

Turning now descriptively to the drawings, in which similar reference characters denote similar elements throughout the several views the figures illustrate a word building game consisting of twenty six playing cubes 10 of which one is shown in FIG. 1, having a letter 12 with a score value 14 on each side 16 thereof. A timer 18, shown in FIG. 2, is for timing the play of the game for approximately two minutes after the cubes 10 are cast upon a flat surface. A player can form at least one word from the letters 12 on the top sides 16 of the cubes 10 and then add up the score values 14.

Figure 3:
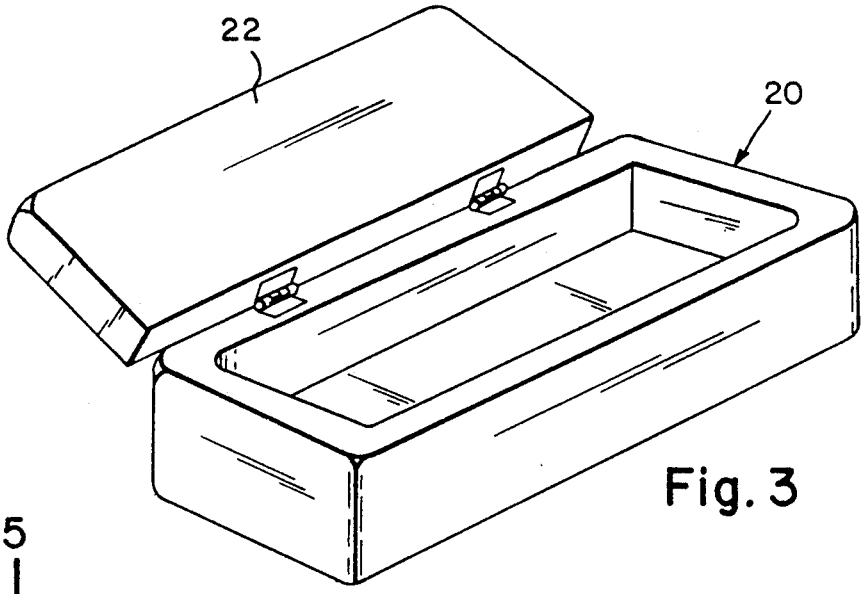
FIG. 3 is a perspective view of a box-shaped container with lid open to hold all the playing cubes and timer therein.

FIG. 3 shows a box-shaped container 20 having a hinged lid 22 for holding all of the playing cubes 10 and the timer 18 therein. The container can look like a jewelry case with a colored velour interior and preferably made of wood of a classic design. The timer 18 includes an hourglass shaped timer 24 embedded within a rectangular transparent block 26 that can be fabricated out of glass-like clear plastic material.

Figure 4:
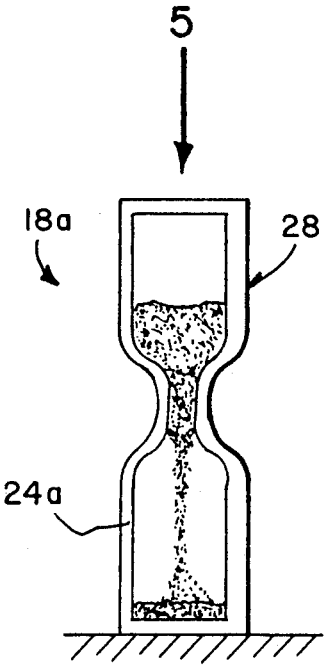
FIG. 4 is a front elevational view of a housing being a combination of an hourglass shaped timer and playing cube scooper.
Figure 5:
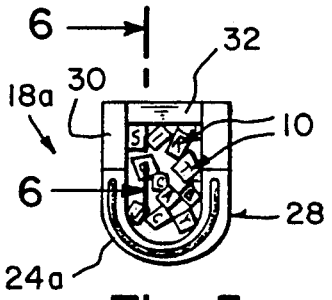
FIG. 5 is a top view taken in direction of arrow 5 in FIG. 4 showing the timer in front and the scooper behind.
Figure 6:
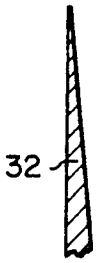
FIG. 6 is a cross sectional view taken along line 6—6 in FIG. 5, showing the tapered blade of the scooper portion in greater detail.

FIGS. 4 and 5 show a modified timer **18*a* that is an hourglass shaped timer 24*a* to form a half portion of a housing 28. A scooper 30 has a tapered blade 32 (see FIG. 6) for holding the playing cubes 10 therein. The scooper 30 is shaped to form the other half portion of the housing 28. The tapered blade 32 can scoop up the playing cubes 10 and then cast the cubes out therefrom, with the hourglass shaped timer 24*a*** ready to be utilized for timing the play of the game.

Each cube 10 is marked with different letters 12 of the alphabet in all six sides 16 and superscripted with numbers 14 as the corresponding value of that letter. There are thirteen groups of different letters distributed on the twenty six cubes 10. The groupings are based on the frequency of their use in majority of the words that are found in the written and spoken words of the English language.

LIST OF THE THIRTEEN GROUPING OF LETTERS

| Guide Group Number | Number Of Cubes | Letter Content/ (Distribution) |
|---|---|---|
| (1) | 3 | A E O I / U - S |
| (2) | 3 | A E O I / Y - U |
| (3) | 3 | T R E O / Blank - I |
| (4) | 2 | N E R S / T - H |
| (5) | 2 | L G P H / W - N |
| (6) | 2 | D R U G / T - N |
| (7) | 2 | B L T N / W - F |
| (8) | 2 | K C M D / S - R |
| (9) | 2 | A P E C / O - R |
| (10) | 2 | C F S N / T - A |
| (11) | 1 | J Y O N / U - R |
| (12) | 1 | T V Q M / X - E |
| (13) | 1 | S N Z C / M - B |

In labelling the cube 10 the side of the cube facing the viewer is the first letter of the Group. Example, in letter Group No. 13: "S" is the first letter. Then turn the cube upward for the next face of the cube for the letter "N" the second upward turn for letter "Z" and the third upward turn for letter "C". For letters "M & B" let the side of the cube with the S-letter face in front. The Right side is for letter "M" and the Left side for letter "B".

LETTERS AND THEIR CORRESPONDING VALUES

| Letters | Value |
|---|---|
| E T O R N | 1 - each |
| S A | 2 - each |
| I U | 3 - each |
| C | 4 |
| D F G | 5 - each |
| H L M | 6 - each |
| P W Y | 7 - each |

-continued

| Letters | Value |
|---|---|
| B K | 8 - each |
| J Q V | 9 - each |
| X Z | 10 - each |

HOW TO PLAY THE WORD BUILDING GAME

Check the number of playing cubes 10 in the Set before starting to play the game. There are twenty six playing cubes in a Set. Each cube has letter markings 12 on each side 16 and its corresponding value in numbers 14 except in the three playing cubes which has a face or side that has no markings being blank. The blank side of the cubes will represent any letter that will be missing in the process of word-building—just to complete the spelling of a word but has no value.

The Game can be played by one person but two or more participants are always better. The first player to play has to be agreed upon among the players and so on. The player takes in both hands, the twenty six playing cubes 10 and casts them on any convenient board or table. Then the player will immediately form a word or several words out of the letters that appears on the upper horizontal surface of the cubes. The rest of the players while waiting for their turn to play will take note of the Two-Minute time limit on the Hourglass Timer 18. The process of forming the words has to stop when the time is up. Then the value of each letters 12 has to be summed up and recorded before the next player will have his turn in casting the cubes and so on. A Score Sheet can be provided for listing all the words created and their corresponding values.

A player is given a bonus by allowing him to play successively or repeat the process for additional scores if within the time limit all the twenty six playing cubes 10 are used up in the word-building process. The player with the highest score Wins after the agreed number of times each player will play is done.

Half the number of playing cubes 10 being thirteen in number may also be used in the game depending on the agreement of the players and the ability to form words. If this will happen, the number of playing cubes 10 to be used has to be maintained at all times throughout the game. Abbreviations such as MR for MISTER and initials like HK for HONG KONG are not allowed.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A word building game comprising:

(a) a plurality of playing cubes, each said cube having a letter with a score value on each side thereof; and (b) means for timing the play of the game for a pre-set time after said cubes are cast upon a flat surface, so that a player can form at least one word from the letters on the top sides of said cubes and then add up the score values; further including a box-shaped container having a hinged lid for holding all of said playing cubes and said timing means therein; wherein said timing means includes an hourglass shaped timer to form a half portion of a housing, in combination with an other half portion of said housing having means for holding and casting said cubes.

2. A word building game as recited in claim 1 wherein said means for holding and casting said cubes comprises a scooper having a tapered blade, said scooper being shaped to form the other half portion of said housing whereby said tapered blade can scoop up said playing cubes and then cast said cubes out therefrom with said hourglass shaped timer ready to be utilized for timing the play of the game.

* * * * *